US009149109B2

(12) United States Patent
Slaton

(10) Patent No.: US 9,149,109 B2
(45) Date of Patent: Oct. 6, 2015

(54) TWO RESERVOIR FLUID DELIVERY SYSTEM

(71) Applicant: Rocket44 LLC, Fort Collins, CO (US)

(72) Inventor: Robin R. Slaton, Fort Collins, CO (US)

(73) Assignee: Rocket44 LLC, Fort Collins, CO (US)

( * ) Notice: Subject to any disclaimer, the term of this patent is extended or adjusted under 35 U.S.C. 154(b) by 0 days.

(21) Appl. No.: 14/370,904

(22) PCT Filed: Jan. 9, 2013

(86) PCT No.: PCT/US2013/020901

§ 371 (c)(1),
(2) Date: Jul. 7, 2014

(87) PCT Pub. No.: WO2013/106483

PCT Pub. Date: Jul. 18, 2013

(65) Prior Publication Data

US 2015/0001253 A1 Jan. 1, 2015

Related U.S. Application Data

(60) Provisional application No. 61/584,638, filed on Jan. 9, 2012.

(51) Int. Cl.

| | |
|---|---|
| ***B67D 7/06*** | (2010.01) |
| ***A45F 3/16*** | (2006.01) |
| ***A45F 3/20*** | (2006.01) |

(52) U.S. Cl.

CPC ... *A45F 3/16* (2013.01); *A45F 3/20* (2013.01); *A45F 2003/166* (2013.01)

(58) Field of Classification Search

CPC ..... A45F 3/16; A45F 3/20; A45F 2003/166; B65D 35/22; B65D 35/242

USPC ..... 222/144, 5, 145.5, 94, 424.5, 175; 206/219, 220; 224/142.8; 220/703, 220/705, 710

See application file for complete search history.

(56) References Cited

U.S. PATENT DOCUMENTS

| | | | | |
|---|---|---|---|---|
| 5,816,457 | A | 10/1998 | Croft | |
| 6,032,831 | A | 3/2000 | Gardner et al. | |
| 6,994,269 | B2 * | 2/2006 | Lien | 239/24 |
| 8,201,711 | B2 * | 6/2012 | Tsai | 222/175 |
| 8,240,581 | B2 * | 8/2012 | Markley | 239/29 |
| 8,604,392 | B1 * | 12/2013 | Ostrom et al. | 219/214 |
| 2003/0075573 | A1 | 4/2003 | Bailey | |
| 2004/0262331 | A1 | 12/2004 | Woolfson | |
| 2007/0090135 | A1 | 4/2007 | Benham | |
| 2009/0212081 | A1 | 8/2009 | Liang | |
| 2010/0012221 | A1 * | 1/2010 | Lien | 141/10 |
| 2010/0084411 | A1 * | 4/2010 | Lien | 220/592.16 |
| 2015/0076180 | A1 * | 3/2015 | Hoskins | 224/148.2 |

FOREIGN PATENT DOCUMENTS

| | | | | |
|---|---|---|---|---|
| WO | WO 2004/009485 A2 * | 1/2004 | | 224/148.2 |
| WO | WO 2009/023849 A1 * | 2/2009 | | 222/175 |

* cited by examiner

*Primary Examiner* — Lien Ngo

(74) *Attorney, Agent, or Firm* — Craig R. Miles; CR Miles P.C.

(57) ABSTRACT

A fluid delivery system having a two fluid reservoirs interconnected by a valved conduit to deliver an amount of fluid from each of a first fluid reservoir and a second reservoir to a user.

15 Claims, 13 Drawing Sheets

TWO RESERVOIR FLUID DELIVERY SYSTEM

This application is the United States National Stage of International Patent Cooperation Treaty Patent Application No. PCT/US2013/020901, filed Jan. 9, 2013, which claims the benefit of U.S. Provisional Patent Application No. 61/584,638, filed Jan. 9, 2012, hereby incorporated by reference herein.

I. BACKGROUND

A fluid delivery system having two fluid reservoirs interconnected by a valved conduit to selectably deliver an amount of fluid from a first fluid reservoir or a second fluid reservoir to the mouth of a user.

Conventional fluid delivery systems provide a single reservoir to which a mouth piece is fluidicly coupled by a length of flexible tube. Fluid can be drawn from the fluid reservoir through the mouthpiece into the user's mouth.

A substantial problem with conventional fluid delivery systems may be that a single reservoir cannot concurrently contain a first amount of fluid in isolation from a second amount fluid. A single reservoir necessitates either containing only a first amount of fluid or mixing a first liquid and a second liquid in the same reservoir. Alternately, two entire conventional fluid delivery systems can be utilized, or the user can carry both the conventional fluid delivery system and discrete containers containing other fluids.

As an example, a user will carry water in the reservoir of a conventional fluid delivery system. Additionally, the user may want to periodically supplement the water with another beverage such as a sports drink which may assist in hydration and electrolyte replacement. Conventional technology necessitates that the additional beverage be carried by the user in separate containers. This approach comes with a several disadvantages in that the additional containers may add additional weight or volume to be carried by the user, or the user must take time to separately locate and handle the additional containers. Also, once the additional container is opened, typically, the amount of drink must be consumed in the entirety or thrown out. The empty containers must be stowed and carried.

There would be a substantial advantage in resolving the long felt need for a fluid delivery system which allows transport of a first fluid in isolation to a second fluid and by user selection the first fluid or the second fluid can be delivered to the mouth of a user by operation of the fluid delivery system.

II. SUMMARY OF THE INVENTION

Accordingly, a broad object of the invention can be to provide a two reservoir fluid delivery system which allows selection and delivery of a first fluid from a first reservoir and a second fluid from a second reservoir to a mouthpiece adapted to be received within the mouth of a user.

Another substantial object of the invention can be to provide a valved conduit which allows selectable delivery of the first fluid from the first reservoir or the second fluid from the second reservoir by drawing upon the mouthpiece received within the mouth of the user.

Another substantial object of the invention can be to provide a valve which can be selectably positioned to fluidly couple one of the first reservoir or the second reservoir (or a mixture of the first fluid and the second fluid) with a fluid dispensing orifice of the mouthpiece.

Naturally, further objects of the invention are disclosed throughout other areas of the specification, drawings, photographs, and claims.

III. A BRIEF DESCRIPTION OF THE DRAWINGS

IV. DETAILED DESCRIPTION OF THE PREFERRED EMBODIMENTS

Figure 1:
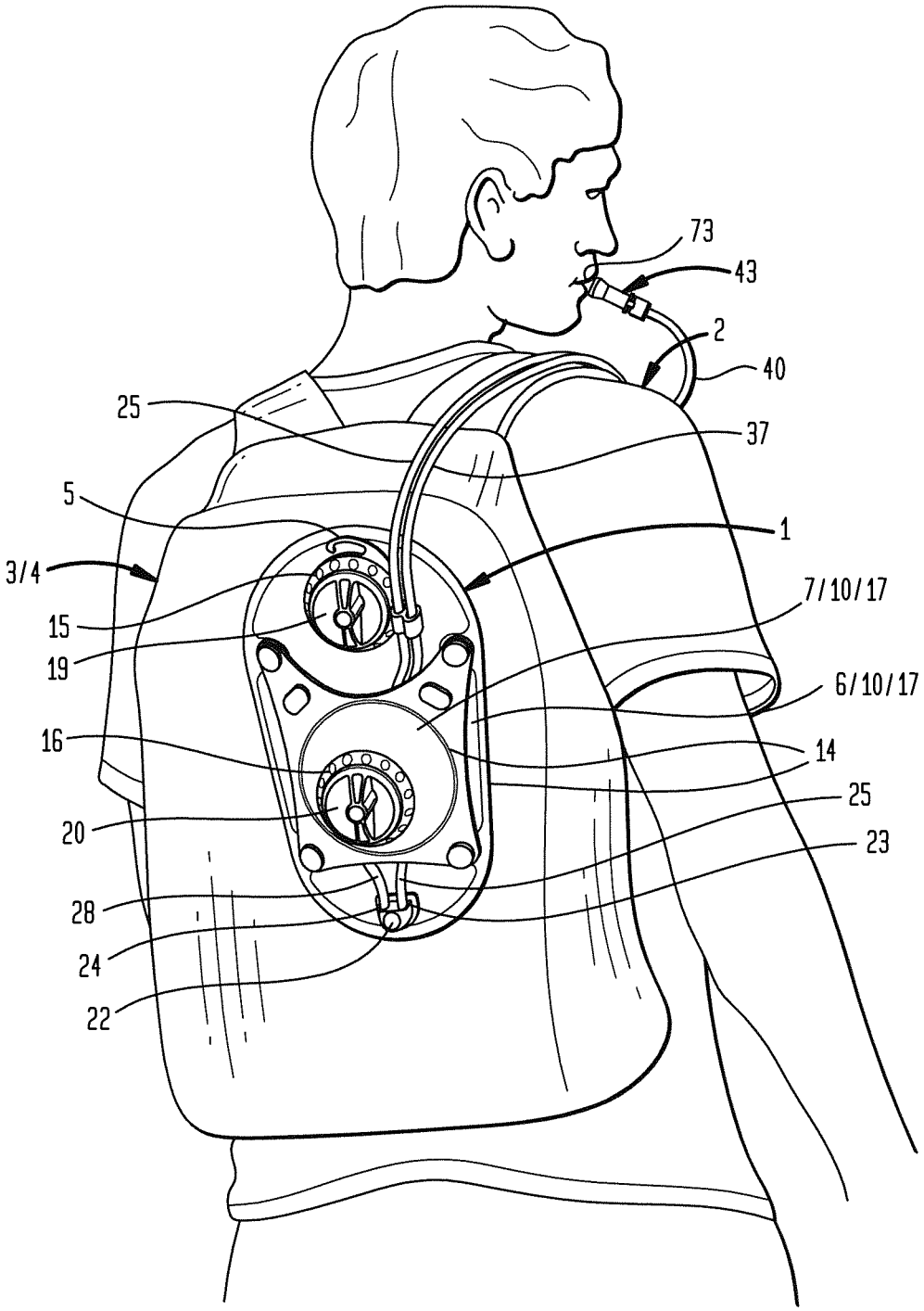
FIG. 1 is an illustration showing a particular method of using a particular embodiment of the inventive two reservoir fluid delivery system coupled to a backpack worn by a user.

Now referring primarily to FIG. 1, which provides an illustrative example of an embodiment of a dual reservoir fluid delivery system (1) useful for hydration of a user (2). Embodiments of the dual reservoir fluid delivery system (1) (also referred to as the "fluid delivery system") can be utilized by a user (2) discrete from or combined or attached to other objects (3) to assist in transport, storage, or use of the fluid delivery system (1). The fluid delivery system (1) can be coupled or removably coupled to an object (3) such as a backpack (4) worn by the user (2) (as shown in the example of FIG. 1); however, the invention is not so limited, and embodiments of the fluid delivery system (1) can be coupled or removably coupled to or contained within one or more of a numerous and wide variety of objects (3), for example, garments such as jackets, pants, belts, or the like; equipment, such as tractors, trucks, automobiles, motorcycles, bicycles, or the like; sporting goods, such as backpacks, vests, or the like, or otherwise. Embodiments of the fluid delivery system (1) can include a mechanical fastener (5) such as a hanger to assist in coupling the fluid delivery system (1) to an object (3) (as shown in the example of FIG. 1).

Figure 2:
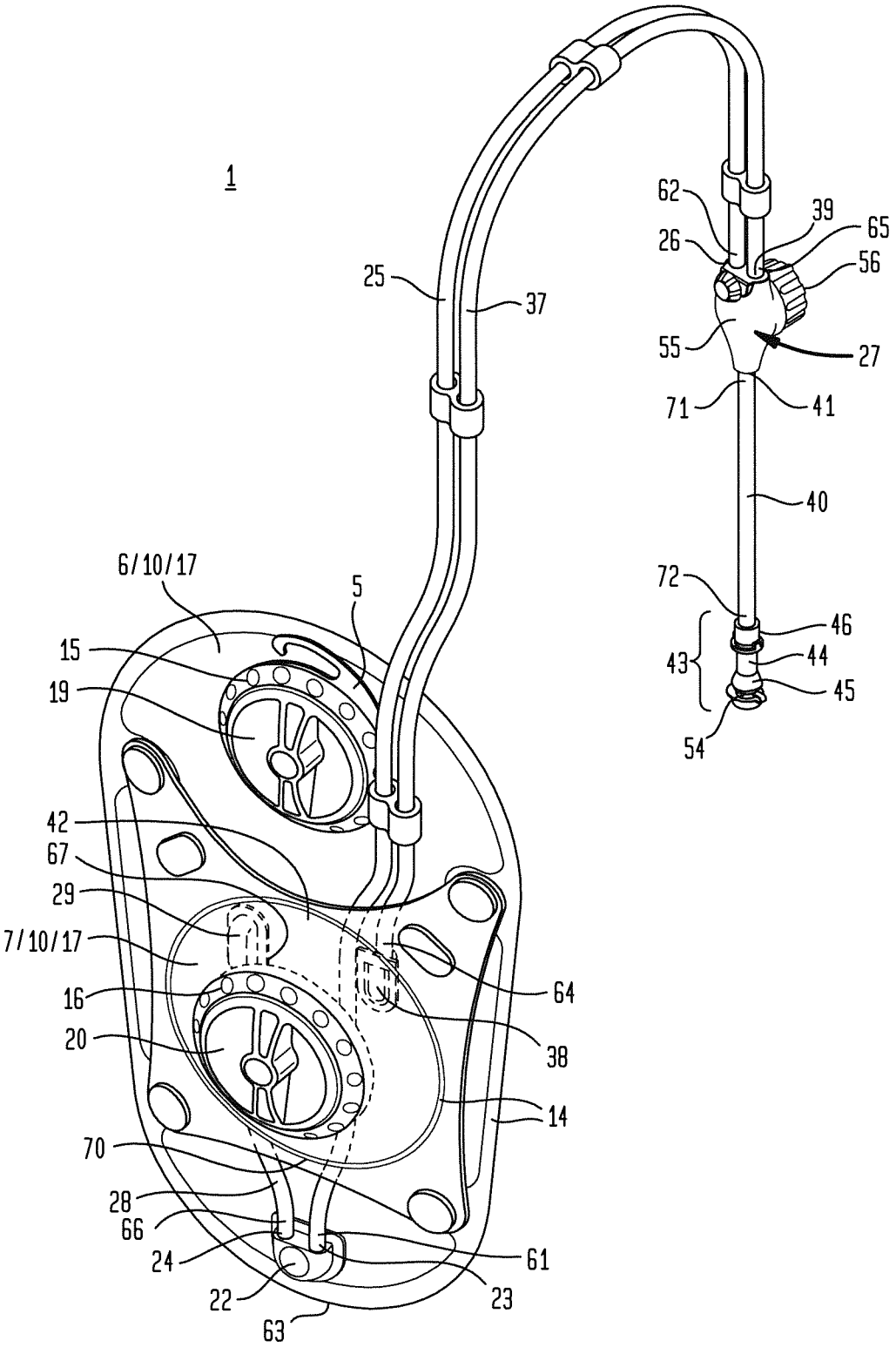
FIG. 2 is a front perspective view of an embodiment of the two reservoir fluid deliver system.
Figure 3:
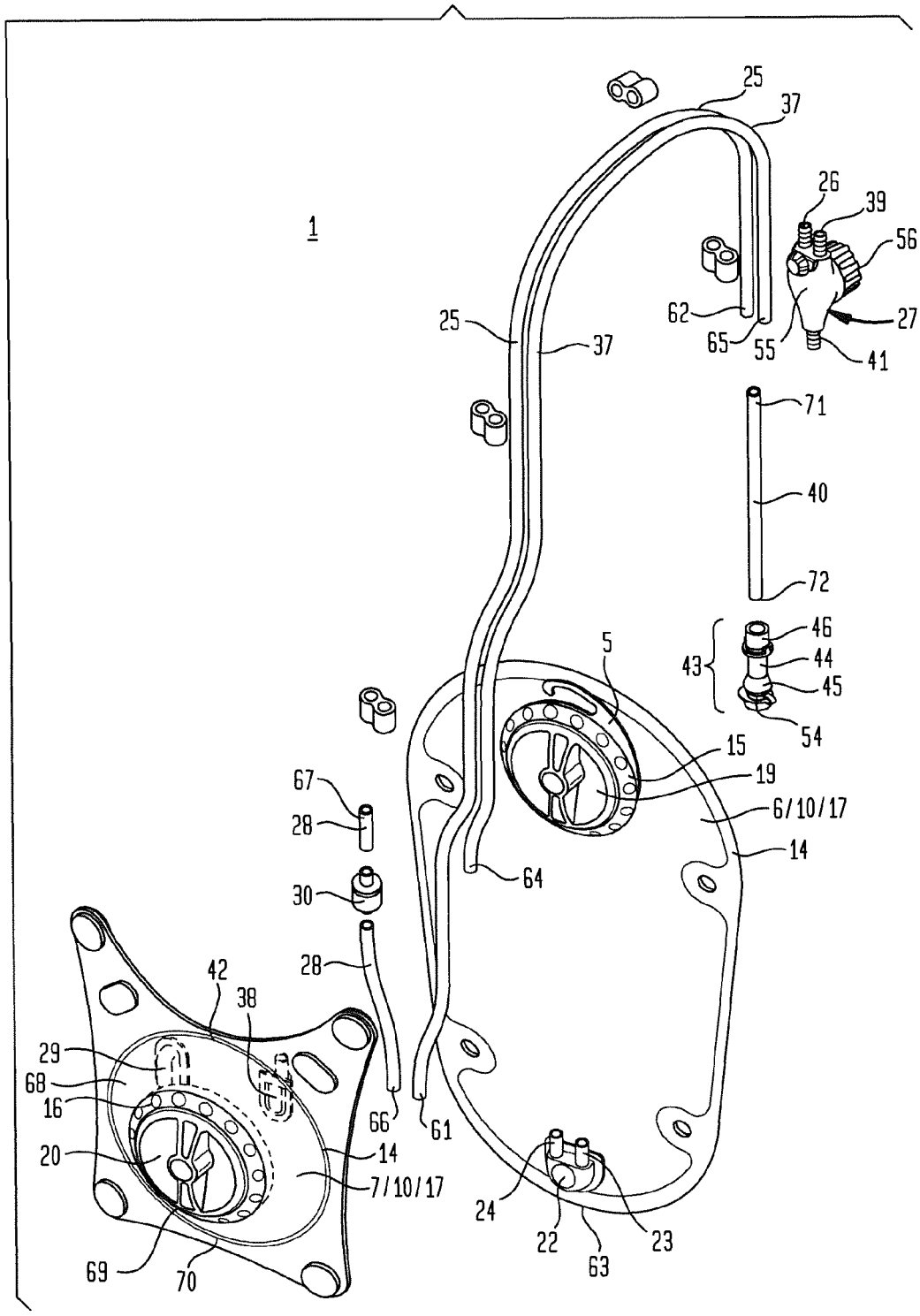
FIG. 3 is an exploded view of the particular embodiment of the two reservoir fluid delivery system shown in FIG. 2.
Figure 4:
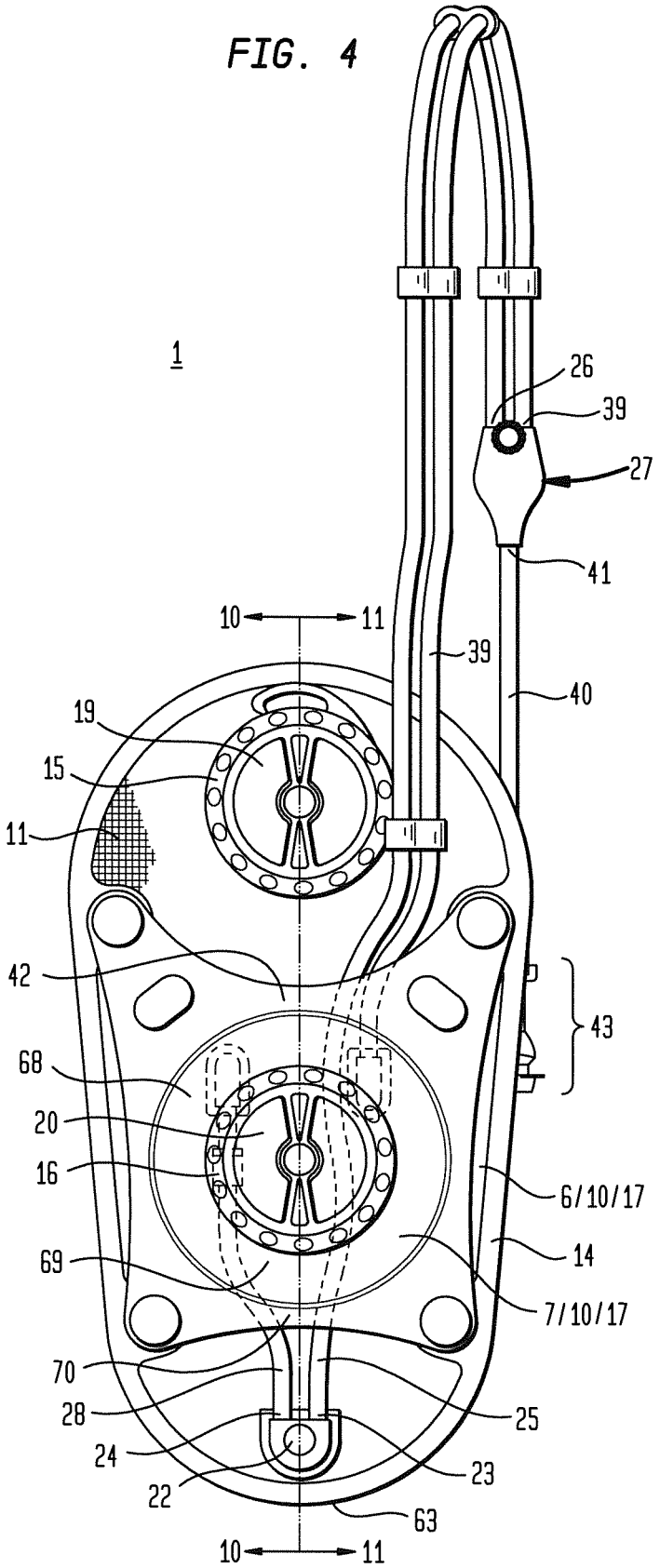
FIG. 4 is a front view of a particular embodiment of the two reservoir fluid delivery system.
Figure 9:
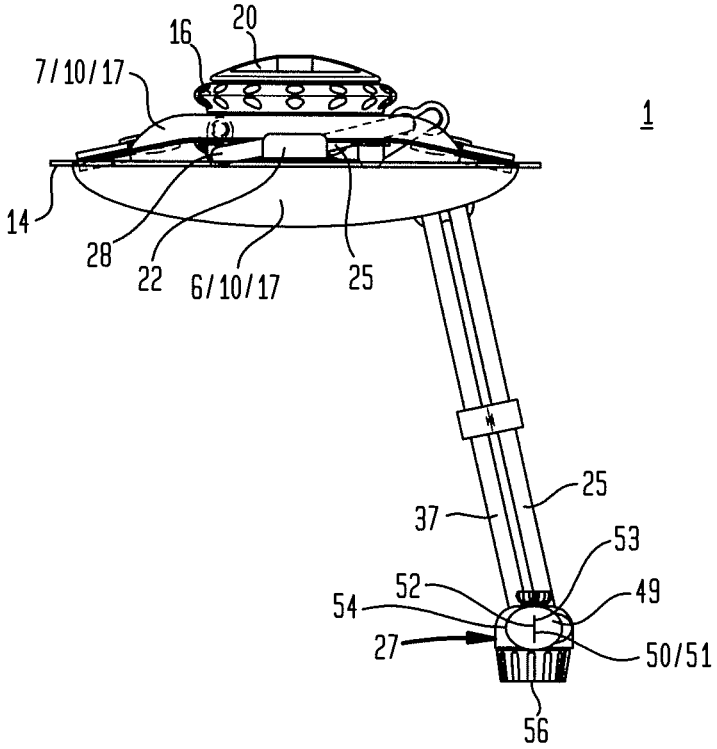
FIG. 9 is a bottom view of a particular embodiment of the two reservoir fluid delivery system.
Figure 10:
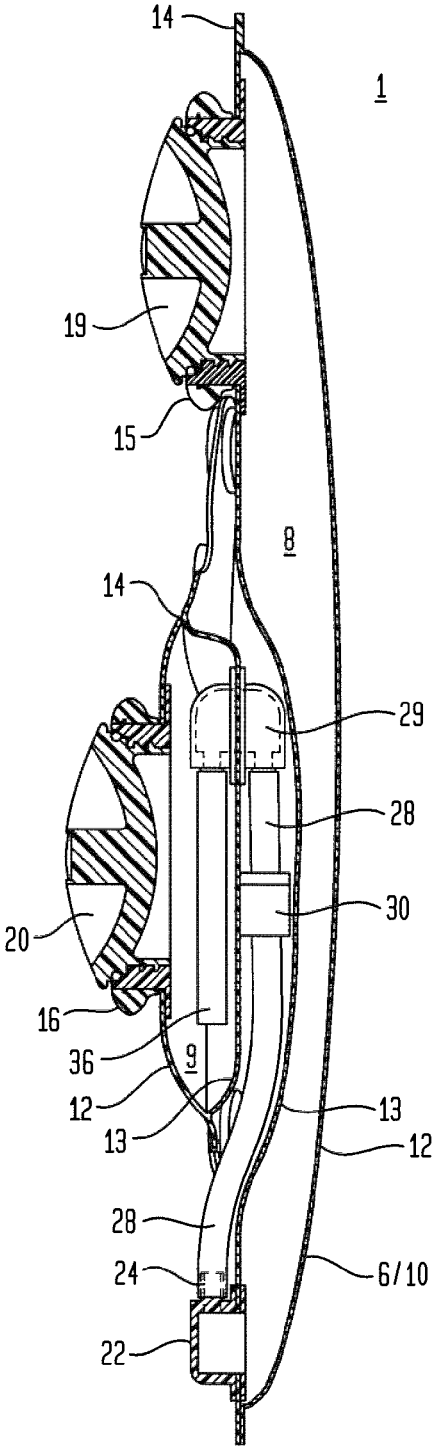
FIG. 10 is cross-section 10-10 of the particular embodiment of the two reservoir fluid delivery system shown in FIG. 4.
Figure 11:
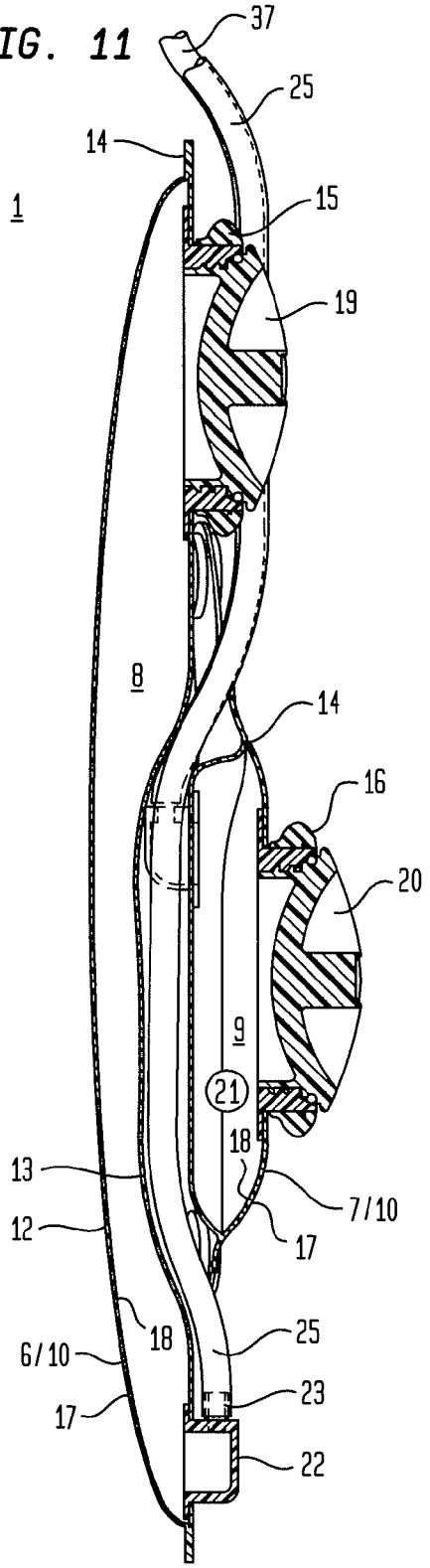
FIG. 11 is cross-section 11-11 of the particular embodiment of the two reservoir fluid delivery system shown in FIG. 4.
Figure 12:
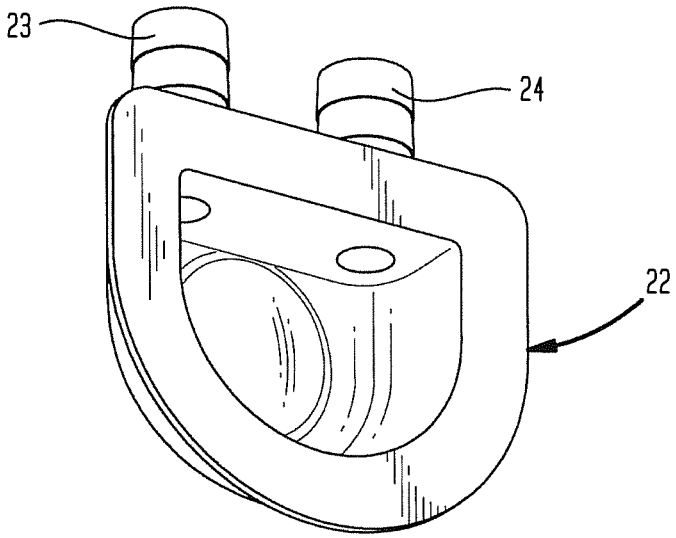
FIG. 12 is a perspective back view of a particular embodiment of the first reservoir exit port coupled to the first reservoir.

Now referring primarily to FIGS. 2 through 11, embodiments of the fluid delivery system (1) include a first reservoir (6) and a second reservoir (7), each adapted contain a first amount of fluid (8) and a second amount of fluid (9) (as shown in the examples of FIGS. 10 and 11). The first reservoir (6) and the second reservoir (7) can be made from a flexible material (10) which may have advantageous resilient or elastic properties, if desired, the flexible material (10) can be in the form of a single layer or laminated layers in various permutations and combinations. For example, particular embodiments of the first and second reservoirs (6)(7) can be made from polyvinylchloride, a mixture of polyester and polyvinylchloride, a mixture of polyvinylchloride and thermoplastic urethane, or the like, or combinations thereof, and can further include reinforcement fibers (11) within flexible material (10) or between layers of the flexible material (10) for additional strength (as shown in the example of FIG. 4). As to particular embodiments, the first reservoir (6) and the second reservoir (7) can each be produced from a first layer (12) and a second layer (13) of flexible material (11) joined proximate the periphery (14) (as shown in the example of FIGS. 10 and 11). The first layer (12) and the second layer (13) can for example be joined proximate the periphery (14) by adhesive, heat sealing, or the like. However, the invention is not so limited, and embodiments of each the first reservoir (6) and the second reservoir (7) can each be formed as a single integral piece about a mold, or otherwise. The first reservoir (6) and the second reservoir (7) can be provided in numerous and varied shapes, sizes, and volumes depending upon the application and the volume of the first amount of fluid (6) or the second amount of fluid (7).

The first reservoir (6) and the second reservoir (7) can include a first reservoir input port (15) and a second reservoir input port (16) respectively. Each of the first reservoir input port (15) and the second reservoir input port (16) communicate between an external surface (17) and an internal surface (18) of the first layer (12) of the respective first reservoir (6) or second reservoir (7). Each of the first reservoir input port (15) and the second reservoir input port (16) can be releasably sealed by a corresponding first reservoir closure element (19) and a second reservoir closure element (20). The first reservoir closure element (19) and the second reservoir closure element (20) can each function to allow the first reservoir (6) and the second reservoir (7) to be opened to empty, fill, or clean and to be closed to respectively contain a first amount of fluid (8) and a second amount of fluid (9). Certain embodiments of the first and second reservoir ports (15)(16) and first and second reservoir closures (19)(20) can be releasably sealably engaged by mated spiral threads (21) (as shown in the examples of FIGS. 10 and 11); however, the invention is not so limited, and each or both of the first reservoir closure element (19) and the second reservoir closure element (20) can releasably sealably engage with the respective first reservoir port (15) and second reservoir port (16) by any configuration of sealing surfaces which sufficiently seal to contain the first amount fluid (8) and a second amount fluid (9) inside the first reservoir (6) and the second reservoir (7) during normal use. While the first reservoir port (15) and second reservoir port (16) and the respective first reservoir closure element (19) and second reservoir closure element (20) are shown as being substantially circular; the invention is not so limited and the first reservoir port (15) and second reservoir port (16) can be provided in any configuration sealable by corresponding the first and second reservoir closure elements (19)(20).

The first amount of fluid (8) and the second amount of fluid (9), while typically different fluids, can also be the same or similar fluids. The first amount of fluid (8) and the second amount of fluid (9) can be a first amount of liquid or a second amount of liquid useful in hydration of the user of the fluid delivery system, including one or more of an amount of water, a beverage, a juice, a sports drink, an energy drink, or the like. For the purposes of this invention the term "hydration" means maintaining bodily fluid balance of a user by intake of an amount of a first liquid (8) or a second liquid (9), or a combination thereof. The term "user" for the purposes of this invention means one or more persons capable of using an embodiment of the fluid delivery system.

As to particular embodiments, the first amount of liquid (8) or the second amount of liquid (9) can comprise an amount of soluble material (21) located in the first reservoir (6) or second reservoir (7) and solubilized by addition of the first amount of liquid (8) or the second amount of liquid (9). The soluble material (21) (as shown in the example of FIG. 11) whether completely or partially soluble in the first amount of liquid (8) or second amount of liquid (9) can be in the form of one or more of: tablets, granules, powder, gel, paste, liquid concentrate, or the like, or combinations thereof.

Embodiments of the fluid delivery system (1), can further include a first reservoir exit port (22) coupled to the first reservoir (6). A first flexible conduit (25) having a length disposed between a first end (61) and a second end (62) can be coupled by the first end (61) to the first reservoir exit port (22) and coupled to a first valve inlet (26) of a reservoir selection valve (27) by the second end (62). As to particular embodiments, the first reservoir exit port (22) can be coupled proximate a bottom (63) of the first reservoir (61) (as shown in the example of FIG. 2).

As to particular embodiments, the first reservoir exit port (22) can include a pair of outlet elements (23)(24) (as shown in the example of FIG. 3). The first end (61) of the first flexible conduit (25) can be sealably coupled to the first of the pair of outlet elements (23). The first flexible conduit (25) can have sufficient length depending upon the application to extend from the first of the pair of outlet element (23) of the first reservoir exit port (22) to couple to the first valve inlet (26) of the reservoir selection valve (27) (as shown in the examples of FIGS. 13A through 13D and FIGS. 14A through 14D).

Embodiments of the fluid delivery system (1), can further include a second reservoir exit port (38) coupled to the second reservoir (6). A second flexible conduit (37) having a length disposed between a first end (64) and a second end (65) can be coupled by the first end (64) to the second reservoir exit port (38) (as shown in the example of FIG. 3). The second end (65) of the second flexible conduit (37) can be coupled to a second valve inlet (39) of the valve (27).

Figure 15A:
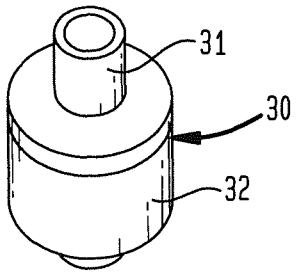
FIG. 15A is a perspective view of the unidirectional flow valve coupled in the flow path of the third conduit which fluidly couples the first reservoir exit port of the first reservoir and the second reservoir inlet port of the second reservoir.
Figure 15B:
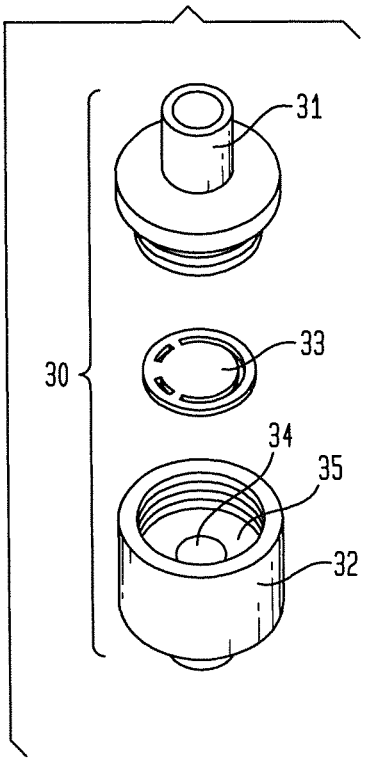
FIG. 15B is a first exploded view of the one way valve shown in FIG. 15A.
Figure 15C:
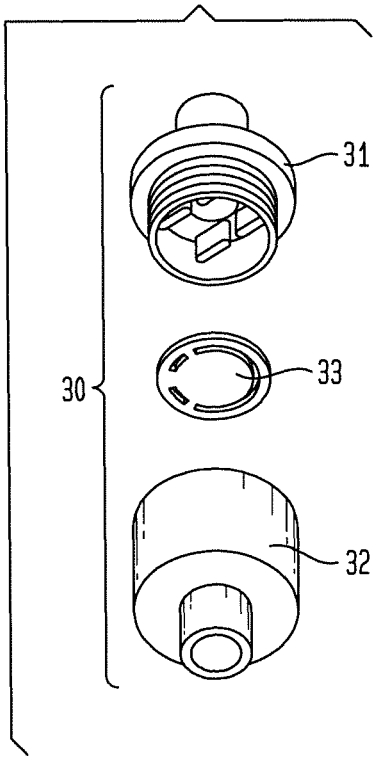
FIG. 15C is a second exploded view of the one way valve shown in FIG. 15A.

A third flexible conduit (28) having a length disposed between a first end (66) and a second end (67) can be coupled by the first end (66) to the second of the pair of outlet elements (24) of the first reservoir exit port (22) of the first reservoir (6) and coupled to a second reservoir inlet port (29) of the second reservoir (7) by the second end (67) (as shown in the example of FIG. 3). As to particular embodiments, a unidirectional flow valve (30) (as shown in the example of FIGS. 3 and 14A through 14C) can be disposed in the flow path of the third flexible conduit (28) to prevent flow from the second reservoir (7) toward the first reservoir (6) and to allow flow from the first reservoir (6) toward the second reservoir (7). As shown in FIGS. 15A-C, an embodiment of the unidirectional flow valve (30) can take the form of a pair of valve bodies (31)(32) configured, upon mated sealed engagement, to retain a flexible seal (33) adjacent the unidirectional flow valve outlet (34). Fluid pressure against the flexible seal (33) can urge the flexible seal (33) against the outlet face (35) to seal the valve outlet (34) interrupting fluid flow. Fluid pressure in the opposite direction urges the flexible seal (33) away from the unidirectional flow valve outlet (34) to allow fluid flow.

A fourth flexible conduit (36) having a length disposed between a first end (68) and a second end (69) can be sealably coupled by the first end (68) to the second reservoir inlet port (29) and extend inside the second reservoir (7) to locate the second end (69) proximate a bottom (70) of the second reservoir (7) allowing egress of the first amount of liquid (8) unidirectionally flowing from the first reservoir into the second reservoir (7) at a location distal from the second reservoir exit port (38) proximate a top (42) of the second reservoir (7). The terms "a top" and "a bottom" relate to the upper and lower portion of each reservoir when oriented for normal use as shown in the example of FIG. 1.

A fifth flexible tube (40) having a length disposed between a first end (71) and a second end (72) can be sealably coupled by the first end (71) to the valve outlet (41) of the valve (27). The fifth flexible conduit (40) can have sufficient length based on the application to extend to the mouth (73) of the user (2). As to particular embodiments, the second end (72) of the fifth flexible tube (40) can be received by the mouth (73) of the user (2) or configured to provide a mouthpiece (43) received by the mouth (73) of the user (2) which can be drawn upon to generate flow of the first amount of liquid (8) from the first reservoir (6) to the mouthpiece (43) or to generate flow of the second amount of liquid (9) from the second reservoir (7) to the mouthpiece (43), or to generate unidirectional flow of the first amount of liquid (8) from the first reservoir (6) toward the second reservoir (7).

Figure 6:
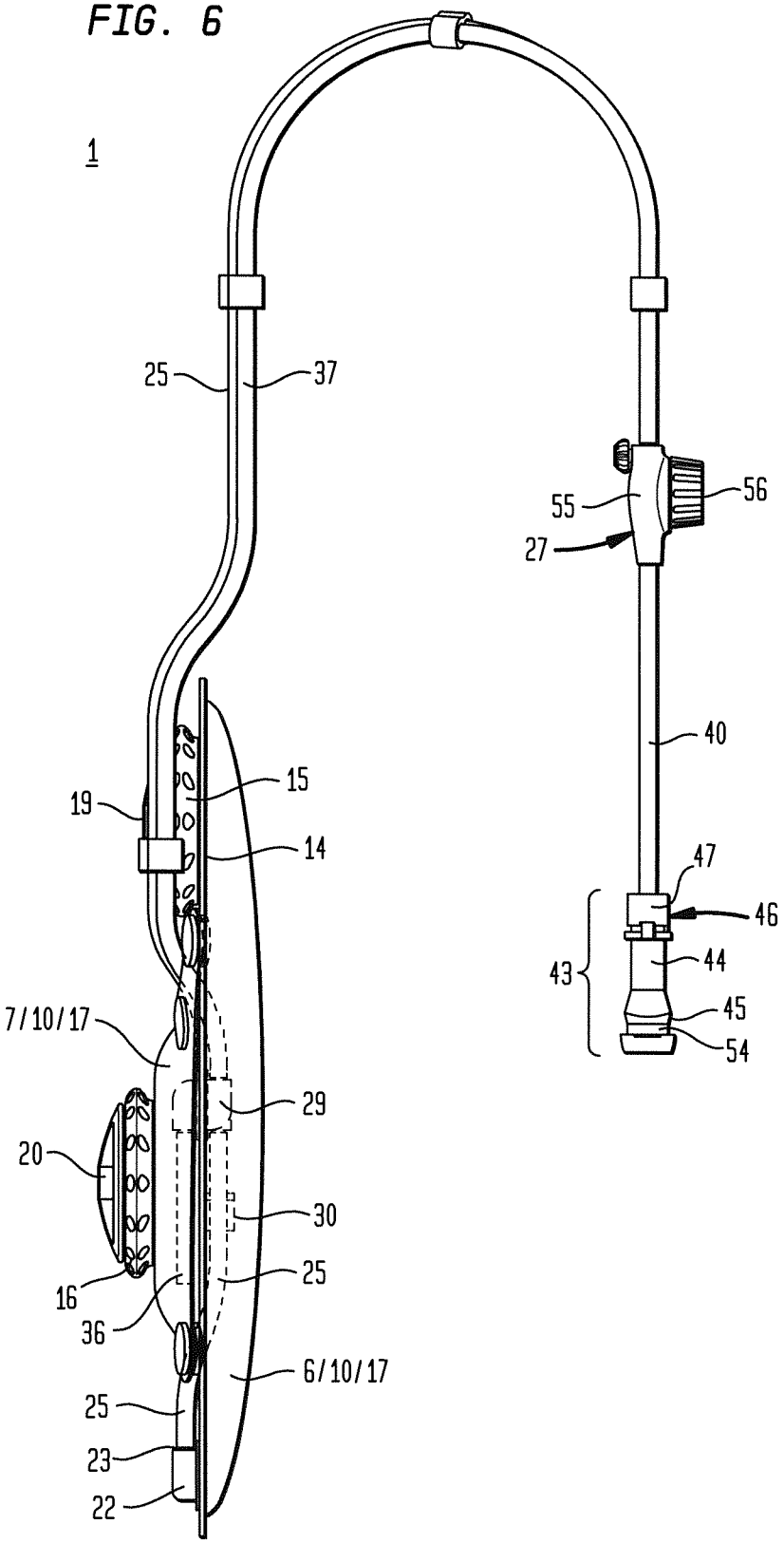
FIG. 6 is first side view of a particular embodiment of the two reservoir fluid delivery system.
Figure 7:
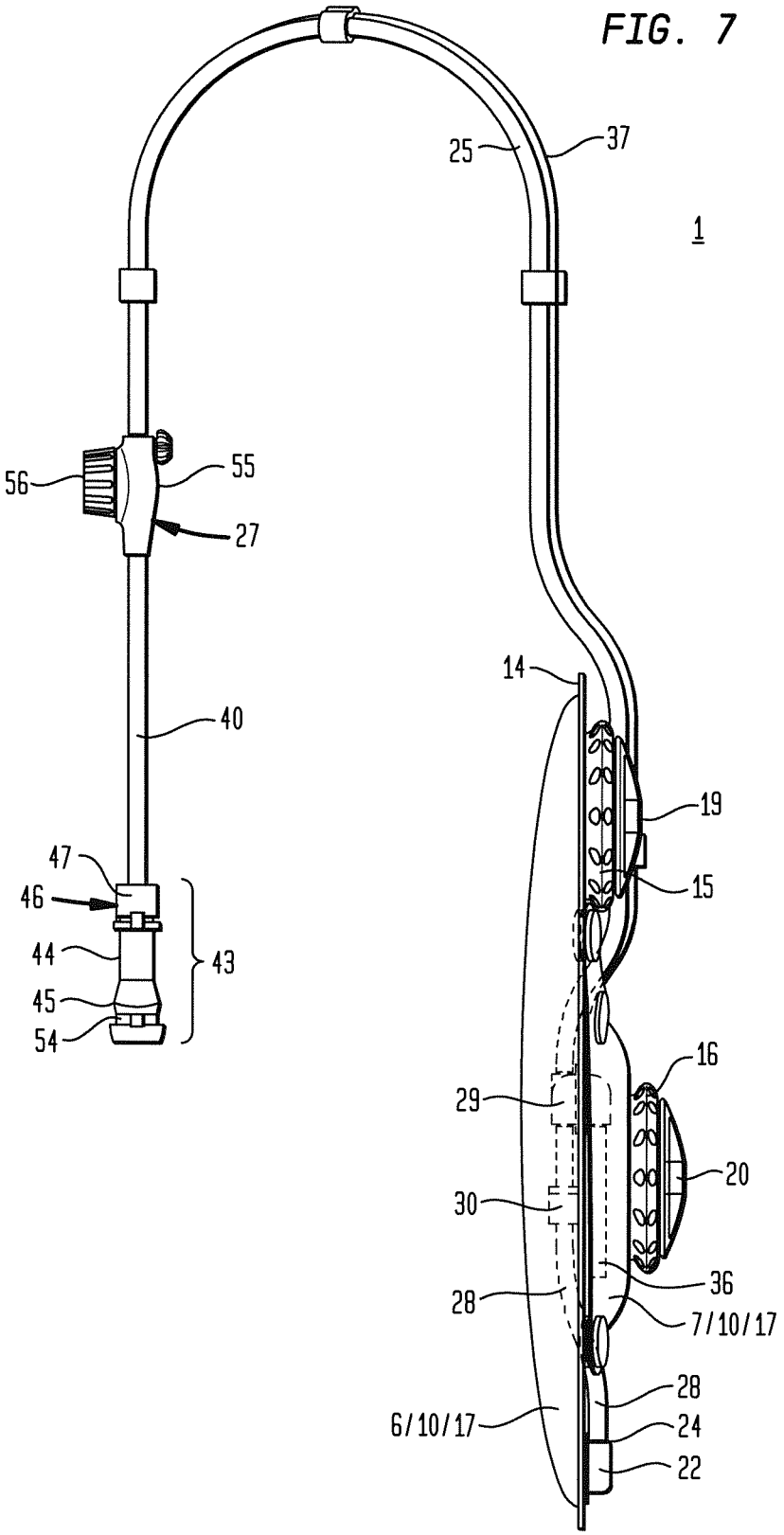
FIG. 7 is a second side view of a particular embodiment of the two reservoir fluid delivery system.
Figure 8:
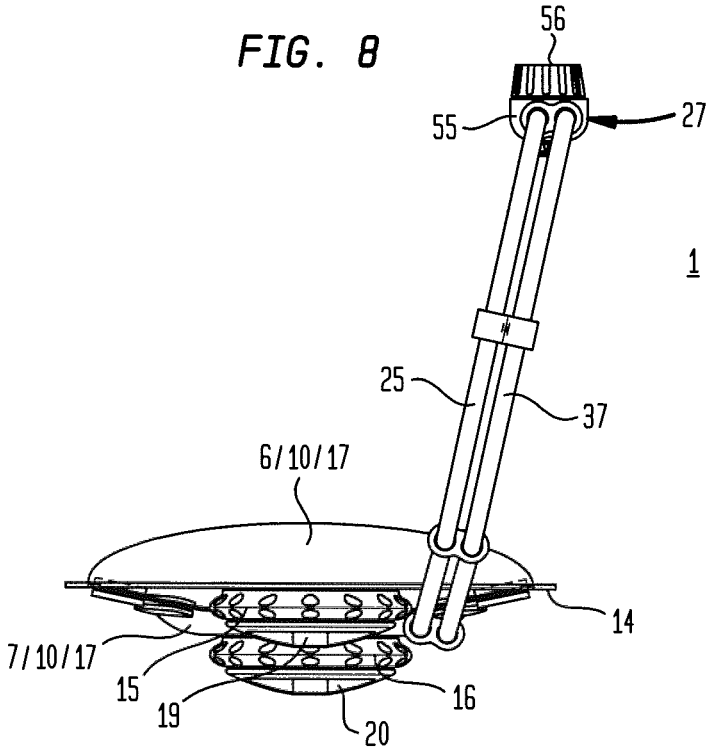
FIG. 8 is a top view of a particular embodiment of the two reservoir fluid delivery system.

As to particular embodiments, the second end (42) of the fifth flexible conduit (40) can be connected to a mouthpiece (43) (as shown in the examples of FIGS. 2 and 3), adapted to be received within the user's (2) mouth to deliver the first fluid (8) or the second fluid (9) to the user (2). Certain embodiments of the mouthpiece (43) can include a neck portion (44) and a head portion (45), the head portion (45) typically of larger cross-section than the neck portion (44). A fluid shut off valve (46) can be coupled to the neck portion (45) to interrupt the flow of the first fluid (8) or the second fluid (9) from the reservoir selection valve (27). One example of a fluid shut off valve (46) provides an end cap (47) rotatably coupled to the end (48) of the neck portion (44) (as shown in the example of FIG. 6). Rotation of the end cap (47) draws the end (48) of the neck portion (44) to seal against the internal surface of the end cap (47) to interrupt the flow of fluid (8)(9). The head portion (45) can terminate in a fluid dispensing face (49) through which the first fluid (8) or the second fluid (9) or both can be selectively dispensed from the mouthpiece (43) through a fluid dispensing orifice (50). The head portion (45) of the mouth piece (43) can be formed from a resilient deformable material such that a normally closed fluid dispensing orifice (50) can be opened by deforming the head portion (45). As to certain embodiments, the normally closed dispensing orifice (50) can be in the form of a slit (51) having a location on the fluid dispensing face (49)) (as shown in the example of FIG. 9). The slit (51) can have opposed side walls (52)(53) which sealably engage until sufficient deformation of the head portion (45) of the mouth piece (43) spreads the side walls (53)(53) a distance apart to allow passage of the first fluid (8) or the second fluid (9) or both. Certain embodiments of the fluid dispensing face (49) can be deformingly responsive to a pressure receiving region (54) of the head portion (45). Applying sufficient pressure to the pressure receiving region (54) opens the normally closed dispensing orifice (50). As to certain embodiments, pressure can be applied by biting the pressure receiving region (54) with sufficient force to open the fluid dispensing orifice (50).

Figure 5:
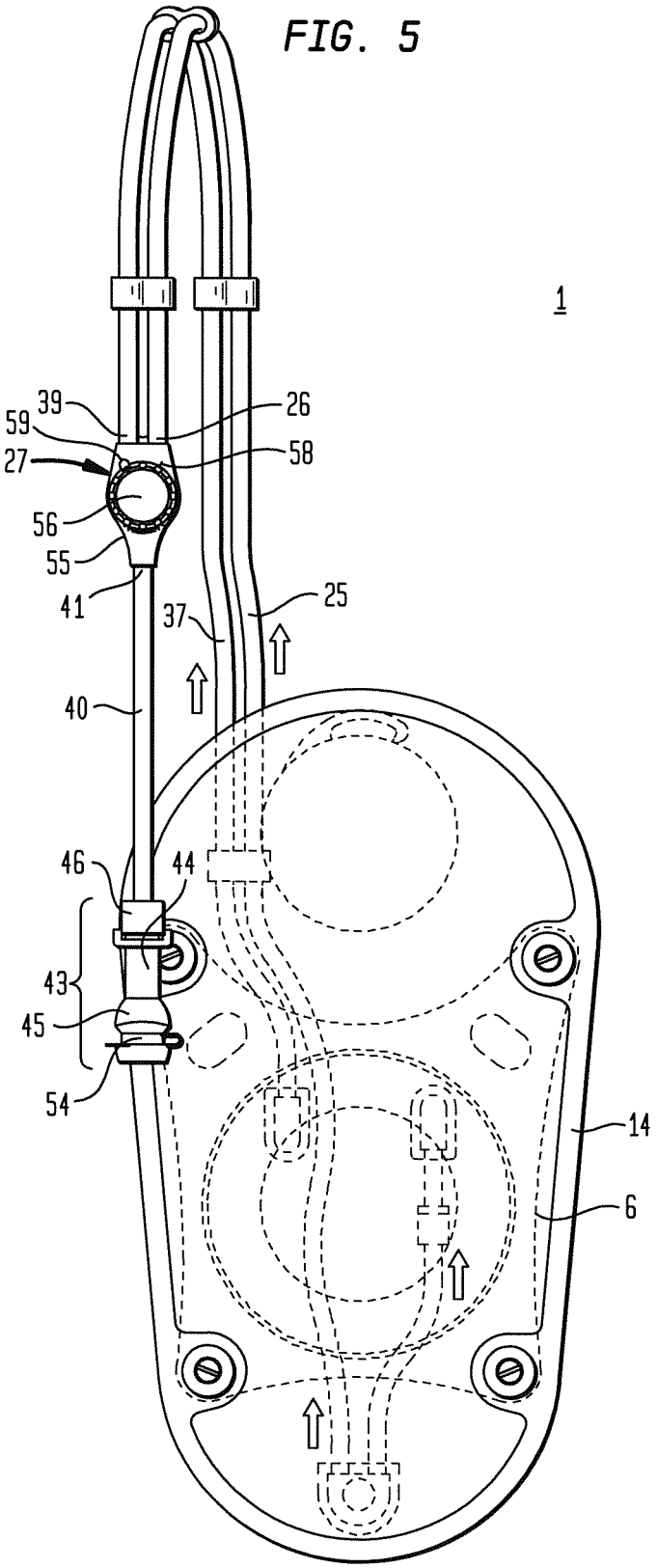
FIG. 5 is a back view of a particular embodiment of the two reservoir fluid delivery system.

Now referring primarily to FIG. 5, the reservoir selection valve (27) can provide a valve housing (55) and a selector body (56) operably engaged in the valve housing (55). Embodiments of the reservoir selection valve (27) (shown in the example of FIGS. 13A though 13E and 14A through 14D as a three way valve) can be established in a first operating condition (58) (as shown in the example of FIG. 5) which fluidly couples the first reservoir exit port (22) with a fluid dispensing orifice ( ) of the mouthpiece (43). The user (2) can draw on the mouthpiece (43) to generate a flow of the first amount liquid (8) from the first reservoir (6) (as shown in the example of FIG. 5) to toward or through the fluid dispensing orifice (50) of the mouthpiece (43). In the first operating condition (58), the unidirectional flow valve (30) prevents flow of the second amount of fluid (9) from the second reservoir (7) toward the first exit port (22) of the first reservoir (6).

The valve (27) can be established in a second operating condition (59) (as shown in the example of FIG. 5) which fluidly couples the second reservoir exit port (38) of the second reservoir (7) to the fluid dispensing orifice ( ) of the mouthpiece (43). The user (2) can draw on the mouthpiece (43) to generate a flow of the second amount of fluid (9) from the second reservoir (7) toward or through the fluid dispensing orifice (50) of the mouthpiece (43). As the user (2) continues to draw upon the mouthpiece (43) in the second operating condition (59) with sufficient urging, the unidirectional flow valve (30) can operate to allow the unidirectional flow of the first amount of liquid (8) from second one of the pair of outlet elements (24) of the first reservoir (6) through the second reservoir inlet (29) of the second reservoir (7). In the event that the second reservoir (7) does not contain a second amount of fluid (8) whether due to depletion or because it was not initially filled, then the first amount of liquid (8) can be drawn through second reservoir exit port (38) of the second reservoir (7).

Embodiments of the invention having a valved conduit, as above described, can provide substantial advantages over other conventional fluid delivery apparatus. First, a first amount of liquid (8) and a second amount of liquid (9) (whether the same or different compositions) can be isolated in a first reservoir (6) and a second reservoir (7) respectively. As a second example, an amount of soluble material (21) can be located in the second reservoir (7), the reservoir selection valve (27) can be placed in a second operating condition (59) (as shown in the example of FIG. 5) which fluidly couples the fluid dispensing orifice (50) of the mouthpiece (43) with the second reservoir exit port (38). As the user (2) draws upon the mouthpiece (43) in the second operating condition (59), the unidirectional flow valve (30) operates to allow a flow of the first amount of liquid (8) from the first reservoir (6) into the second reservoir (7). The amount of soluble material (21) can be solubilized in the first amount of liquid (8) to provide the second amount of liquid (9) having a different composition from the composition of the first amount of liquid (8). Continued drawing upon the mouthpiece (43) by the user (2) can generate a flow of the second amount of fluid (9) toward or through the fluid dispensing orifice (50) of the mouthpiece (43).

Figure 13A:
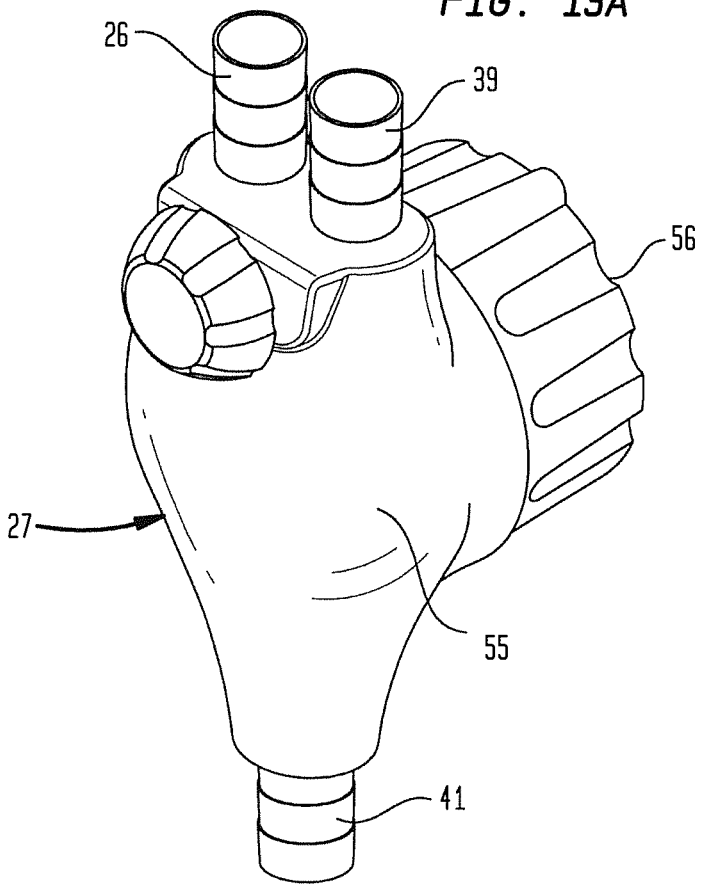
FIG. 13A is a back perspective view of a particular embodiment of a three way valve which fluidly couples the first reservoir exit port of the first reservoir and the second reservoir exit port of the second reservoir and the mouthpiece of particular embodiments of the two reservoir fluid delivery system.
Figure 13B:
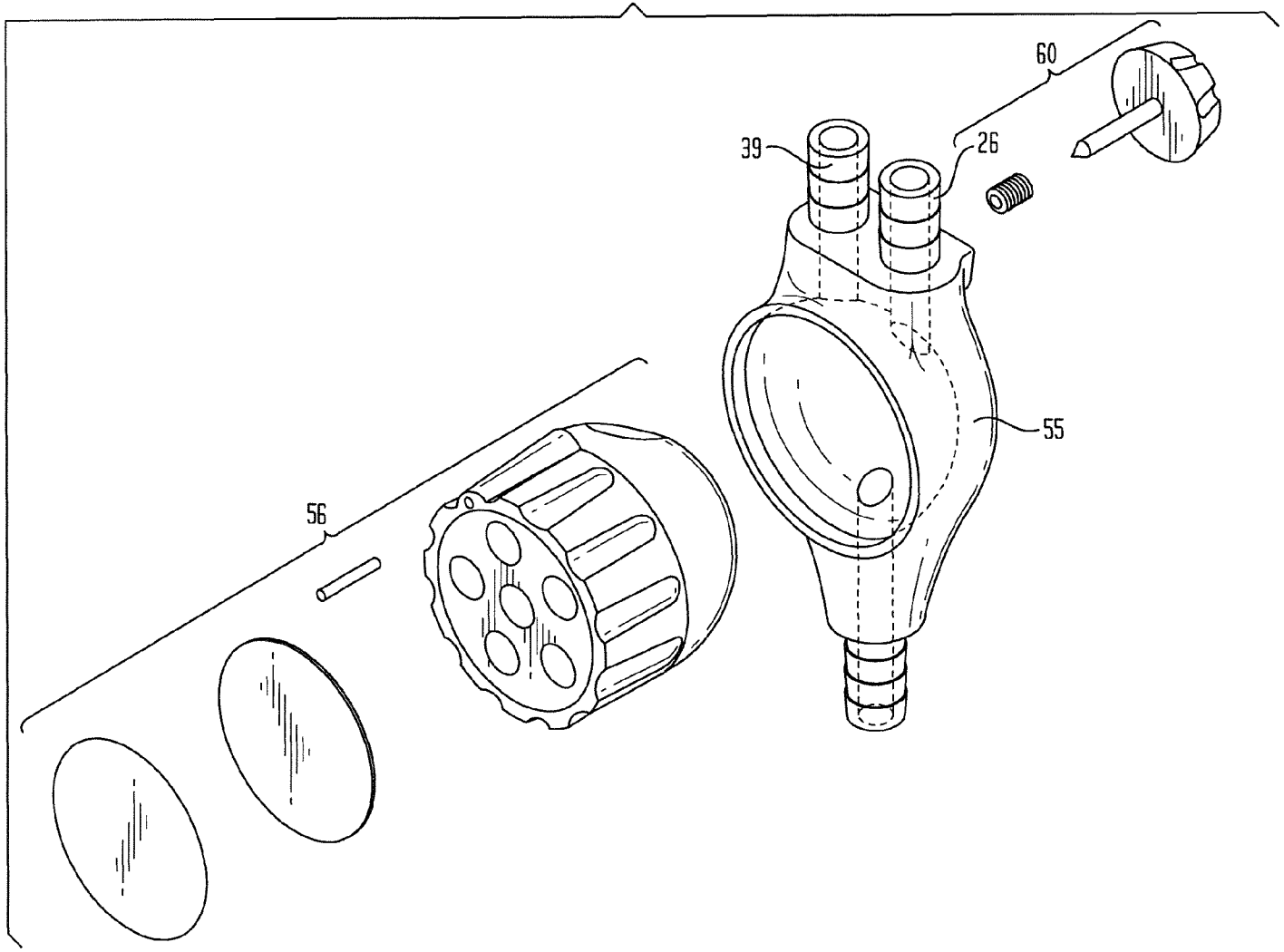
FIG. 13B is an exploded view of the particular embodiment of the three way valve shown in FIG. 13A.
Figure 13C:
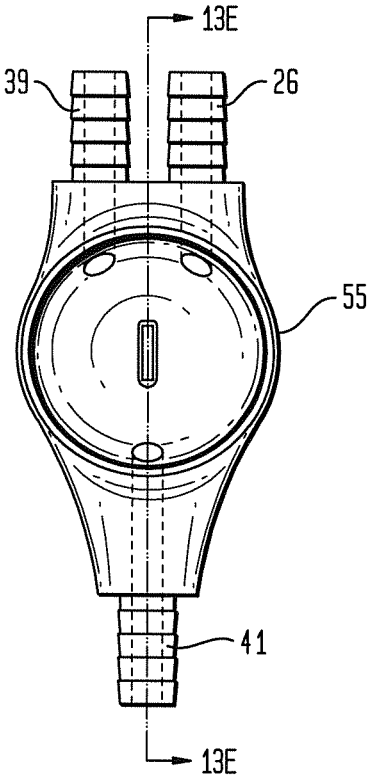
FIG. 13C is a top view of the valve body of the three way valve shown in FIG. 13A.
Figure 13D:
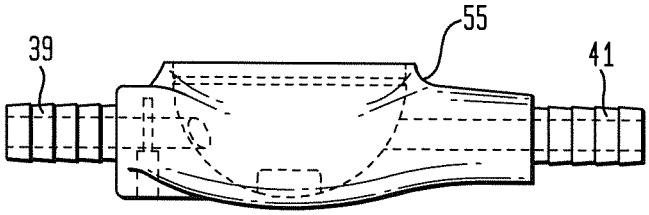
FIG. 13D is a side view of the valve body of the three way valve shown in FIG. 13A.
Figure 13E:
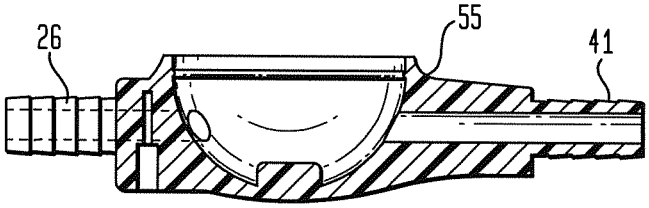
FIG. 13E is cross-section 13E-13E shown in FIG. 13C.
Figure 14A:
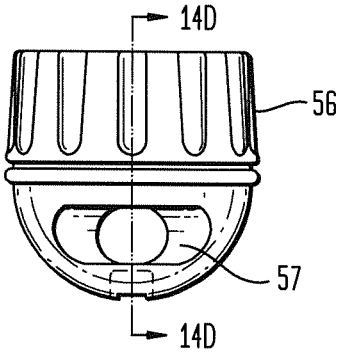
FIG. 14A is a front view of the valve selector which rotates within the body of the three way valve shown in FIG. 13C.
Figure 14C:
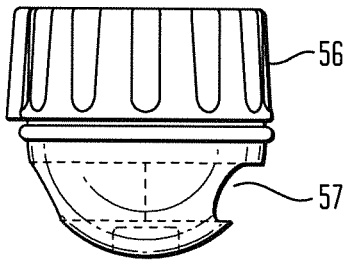
FIG. 14C is a side view of the valve selector.
Figure 14B:
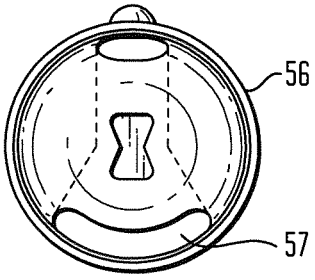
FIG. 14B is a bottom view of the valve selector.
Figure 14D:
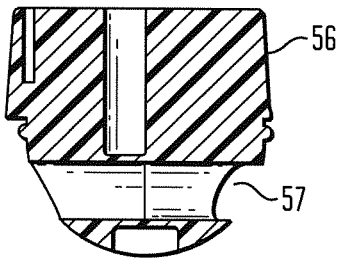
FIG. 14D is a cross-section 14D-14D shown in FIG. 14A.

Now referring primarily to FIGS. 5 and 13A through 13E and 14A through 14D, the mouthpiece (43) positioned in the user's (2) mouth (and deformed as to those embodiments which require pressure to open a normally closed fluid dispensing orifice (50)) can be used to selectably draw the first fluid (8) or the second fluid (9) (or both) from the first reservoir (6) and the second reservoir (7) into the mouth of the user (2). Now referring primarily to FIG. 13C and FIG. 14B, the reservoir selection valve (27), as to particular embodiments, can include a valve housing (55) which locates the first inlet (26) the second inlet (39) and the outlet (41) in fixed relation. The selector body (56) includes a selectably adjusted flow path (57) positionable by rotation of the selector body (56) within the valve housing (55) to allow fluid communication with one of the first inlet (38) or the second inlet (39) and always in fluid communication with the outlet (41) to selectably fluidly couple the outlet (41) with one of the first valve inlet (26) or the second valve inlet (39). Embodiments of the reservoir selection valve (60) can further include a securement element (60) which allows the reservoir selection valve (27) to be secured to a wide variety of objects (3). While FIG. 13B shows the securement element (60) as a tack pin; the invention is not so limited and the securement element (60) could take the form of any mechanical fastener useful in fixedly positioning the reservoir selection valve (27), such as a clasp, or otherwise.

The flexible conduits (25)(28)(36)(37)(40) (certain embodiments may provide one or more of the flexible conduits in the form of substantially rigid or rigid conduits such that the term flexible conduit encompass any form of conduit useful in practicing a particular application) can be fabricated or molded from various materials compatible with carrying a flow of the first amount of fluid (8) or the second amount of fluid (9) (or both) for consumption by the user (2) such as cross-linked polyethylene, polyurethane, vinyl, or the like. The second reservoir inlet port (29) and the first and second reservoir exit ports (22)(38) can be fabricated or molded from similar materials. Additionally, while the flexible conduits (25)(28)(36)(37)(40) shown in the Figures as separate discrete conduits, certain embodiments may be formed, molded or extruded as a flexible conduit having a plurality of flow paths. For example, the first flexible conduit (25) and the second flexible conduit (37) can be formed as one piece having two discrete flow paths.

As can be easily understood from the foregoing, the basic concepts of the present invention may be embodied in a variety of ways. The invention involves numerous and varied embodiments of an inventive two reservoir fluid delivery system and methods of using the inventive two reservoir fluid delivery system.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of "a closure" should be understood to encompass disclosure of the act of "closing"—whether explicitly discussed or not—and, conversely, were there effectively disclosure of the act of "closing", such a disclosure should be understood to encompass disclosure of "a closure" and even a "means for closing." Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

Moreover, for the purposes of the present invention, the term "a" or "an" entity refers to one or more of that entity; for example, "a light source" refers to one or more of those light sources. As such, the terms "a" or "an", "one or more" and "at least one" can be used interchangeably herein.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment.

Thus, the applicant(s) should be understood to claim at least: i) each of the child carrier restraint devices herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

I claim:

1. A dual reservoir fluid delivery system, comprising;

a) a first reservoir adapted to contain a first amount of liquid, said first reservoir having an first reservoir exit port adapted to allow passage of said first amount of liquid, wherein said first reservoir exit port includes a pair of outlet elements;

b) a first flexible conduit having a length disposed between a first end and a second end, said first end coupled to a first one of said pair of outlet elements of said first reservoir exit port;

c) a second reservoir adapted to contain a second amount of liquid, said second reservoir having a second reservoir exit port adapted to allow passage of said second amount of liquid;

d) a second flexible conduit having a length disposed between a first end and a second end, said first end coupled to said second reservoir exit port;

e) a third flexible conduit having a length disposed between a first end and a second end, said first end of said third flexible conduit coupled to a second one of said pair of outlet elements of said first reservoir exit port and a second end of said third flexible conduit coupled to a second reservoir inlet port coupled to said second reservoir;

f) a valve having a valve housing and a selector body, said valve housing including:

i) a first valve inlet which couples to said second end of said first flexible conduit;

ii) a second valve inlet which couples to said second end of said second flexible conduit;

iii) a valve outlet adapted for egress of said first amount of fluid and said second amount fluid from said valve housing; and said selector body operationally engaged in said valve housing to select a flow path to fluidly couple said first valve inlet or said second valve inlet to said valve outlet; and g) a mouthpiece coupled to said valve outlet, said mouthpiece adapted to be received within a mouth of a user.

2. The system of claim 1, further comprising a unidirectional flow valve coupled to said third flexible conduit, said unidirectional flow valve operable to generate a unidirectional flow of said first amount of liquid from said second one of said pair of outlet elements of said first reservoir toward said second reservoir inlet.

3. The system of claim 2, wherein second reservoir exit port has a location proximate a top of said second reservoir and wherein said second reservoir inlet has a configuration which delivers said flow of said first amount of liquid proximate a bottom of said second reservoir.

4. The system of claim 1, wherein said first reservoir further includes a first reservoir input port sealable by a first reservoir closure element.

5. The system of claim 4, wherein said second reservoir further includes a second reservoir input port sealable by a second reservoir closure element.

6. The system of claim 5, wherein said first reservoir and said second reservoir sealable by threaded engagement of said first reservoir closure element and said second reservoir closure element.

7. The system of claim 1, wherein said first reservoir and second reservoir comprise a first flexible reservoir and a second flexible reservoir.

8. The system of claim 7, wherein said first flexible reservoir and said second flexible reservoir each comprise a first layer of flexible material and a second layer of flexible material sealably joined to correspondingly provide an inside volume for containment of said first amount of liquid and said second amount of liquid.

9. The system of claim 8, further comprising one or more reservoir fastening elements which couple said second flexible reservoir to said first flexible reservoir.

10. The dual reservoir fluid delivery system of claim 2, wherein said first amount of liquid and said second amount of liquid have different compositions.

11. The dual reservoir fluid delivery system of claim 2, further comprising a soluble material disposed in said second reservoir, said soluble material soluble in unidirectional flow of said first amount of liquid from said second one of said pair of outlet elements of said first reservoir to said second reservoir inlet.

12. The dual reservoir fluid delivery system of claim 1, wherein said mouthpiece delivers said flow of said first amount of fluid or said second amount of fluid through a fluid dispensing orifice.

13. The dual reservoir fluid delivery system of claim 12, wherein said mouthpiece further comprises a head portion having a pressure receiving portion and a fluid dispensing face which includes said fluid dispensing orifice in a normally closed condition, said pressure receiving portion resiliently deformable upon receiving sufficient pressure to open said fluid dispensing orifice.

14. The dual reservoir fluid delivery system of claim 13, wherein said fluid dispensing orifice comprises a slit in said fluid dispensing face having a opposed of side walls sealably engaged until sufficient pressure upon said pressure receiving portion spreads said opposed side walls a distance apart.

15. The dual reservoir fluid delivery system of claim 14, wherein said mouthpiece further comprises a neck portion including a fluid shut off valve operable to interrupt flow of said first amount of fluid or said second amount of fluid delivered from said valve.

* * * * *